United States Patent [19]

McCarthy et al.

[11] 3,956,726

[45] May 11, 1976

[54] HEAT DETECTING CONDUCTOR AND CIRCUIT

[75] Inventors: John J. McCarthy, Bethany, Conn.; Kenneth C. Starkey, Grove City, Ohio

[73] Assignee: Cerro Corporation, New York, N.Y.

[22] Filed: Dec. 23, 1974

[21] Appl. No.: 535,827

[52] U.S. Cl. ..... 337/414; 337/416

[51] Int. Cl.[2] ..... H01H 37/76

[58] Field of Search ..... 337/15, 17, 125, 221, 337/414, 415, 416

[56] References Cited

UNITED STATES PATENTS

| | | | |
|---|---|---|---|
| 2,774,850 | 12/1956 | Ziccardi | 337/415 |
| 3,138,686 | 6/1964 | Mitoff et al. | 337/416 |
| 3,588,776 | 6/1971 | Horwinski | 337/415 |

*Primary Examiner*—G. Harris

*Attorney, Agent, or Firm*—DeLio and Montgomery

[57] ABSTRACT

A heat detecting conductor embodied in a flat tape wherein conductive strips in an open circuit are separated, at acceptable temperatures, by thermoplastic insulating material which is adapted to melt at predetermined elevated temperatures and to permit the conductive strips to come into contact with each other, thereby closing the electric circuit and actuating an audible and/or visual alarm. The heat detecting conductor may be associated with a cable carrying one or more service lines or with a cable connected to one or more heat detecting devices, as a back-up therefor, or may be used alone.

9 Claims, 7 Drawing Figures

HEAT DETECTING CONDUCTOR AND CIRCUIT

This invention relates to a heat detecting conductor comprising a pair of conductive strips constituting two legs of an open circuit, associated in a flat tape and separated by thermoplastic insulating material which is solid at normal or acceptable temperatures but which is adapted to melt at predetermined elevated temperatures and to permit the conductive strips to come into contact with each other, thereby closing an electric circuit and actuating an audible and/or visible alarm or other device or system.

Cables having heat responsive windings are known wherein a wire carrying one side of an open electric circuit is wound spirally in one direction and a wire carrying the other side of the same circuit is wound spirally in the opposite direction, to cross the first wire at a multiplicity of crossing points, one or both wires being insulated with a material adapted to permit shorting of the circuit at one or more crossing points upon the application of heat. Another known winding comprises a carrier ribbon with one or more conductive strips of low melting point metal arranged in a closed circuit which is opened when the metal strips are melted by exposure to heat. Other combinations of wires and insulating coatings, for use in heat sensing systems, are likewise known.

It is accordingly an object of the present invention to provide an arrangement of conductive strips in a unitary tape form for use in an open circuit heat sensing system, designed to short upon exposure to heat at a predetermined temperature.

It is a further object of the invention to provide such a device which is adapted for use as a winding on a power or other cable, independent of the purpose for which the cable is being used.

It is another object of the invention to provide such a device which can be used to supplement or back up a standard heat detection circuit containing suitably located heat detection devices.

It is a further object of the invention to provide a device adapted to detect a rapid rise in temperature external to the cable jacket, which device will trigger an alarm of any type without affecting the integrity of the cable.

It is a still further object of the invention to provide certain improvements in the form, construction, arrangement and materials of the several elements whereby the above named and other objects may effectively be attained. The invention accordingly comprises an article of manufacture possessing the features, properties and the relation of elements which are exemplified in the article hereinafter described, and the scope of the invention will be indicated in the claims.

Practical embodiments of the invention are shown in the accompanying drawing, wherein.

Figure 1:
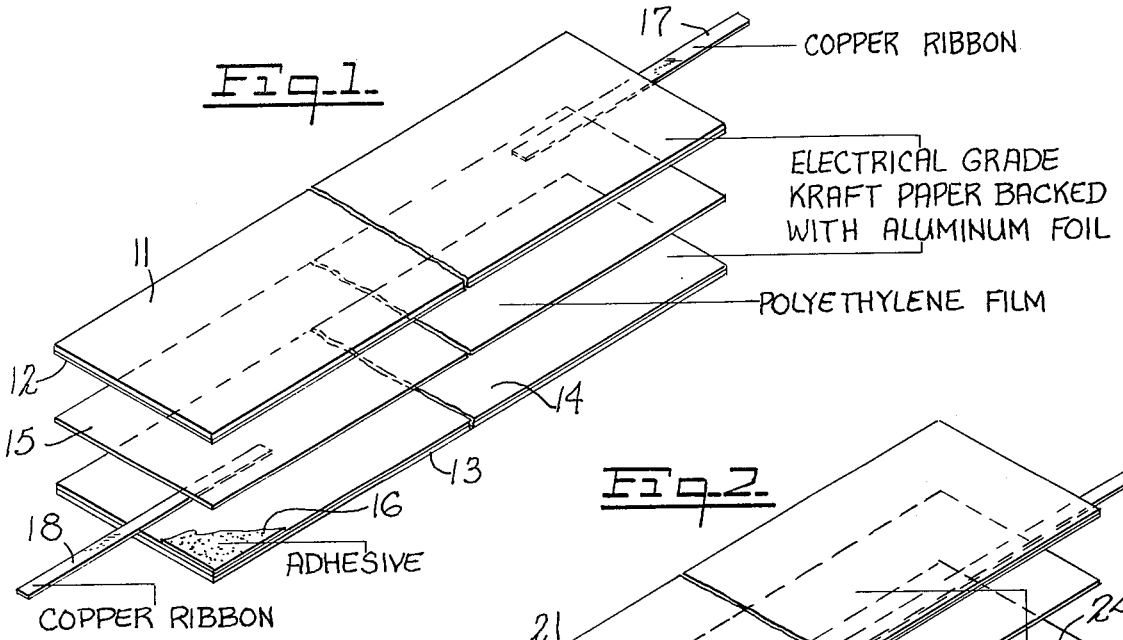
FIG. 1 represents an enlarged partially exploded perspective view of a first form of the conductor tape.

Referring to the drawing, and particularly FIG. 1 thereof, the tape is shown as comprising a first supporting strip of electrical grade kraft paper 11 approximately 1 inch wide and 0.003 inch thick backed with a layer of aluminum foil 12 approximately 0.00035 inch thick, a second supporting strip of paper 13 backed with foil 14, identical with the strip and layer 11, 12, and a film 15 of low molecular weight polyethylene interposed between the foil surfaces 12 and 14. The film 15 constitutes an insulating layer and is adhered to the foil surfaces by the provision of an adhesive 16, such as the silicone room temperature vulcanizing adhesive sold under the name "Auto Seal" by General Electric. Contacts with the foil strips may be established through terminals 17, 18 in the form of silver coated copper ribbons 3 inches long by 0.060 inch wide and 0.003 inch thick bonded to either or both ends of the foil strips, as needed.

Figure 2:
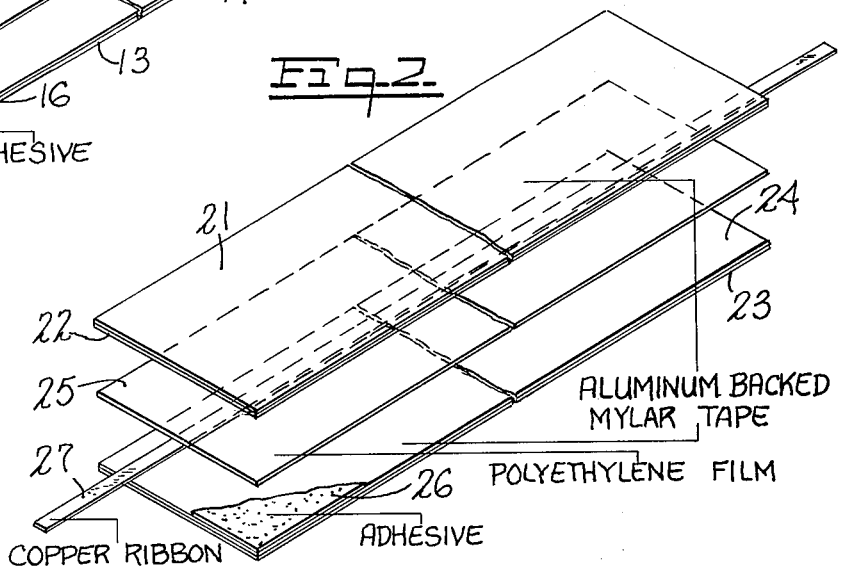
FIG. 2 represents a similar view of a second form of the conductor tape.

In the alternative form of tape shown in FIG. 2, a first supporting strip of Mylar 21 approximately 1 inch wide and 0.002 inch thick, backed with aluminum foil 22, is assembled with a second supporting strip of Mylar 23 backed with foil 24, the foil surfaces being separated by an inch wide, 0.001 inch thick, film 25 of low molecular weight polyethylene, adhered to the foil by means of an adhesive 26, like the adhesive 16 mentioned above. In this case a silver coated copper wire ribbon 27, 0.004 inch thick by 0.075 inch wide is sandwiched longitudinally between the polyethylene film 25 and one of the aluminum foil surfaces, to act as a drain wire and to aid in establishing a short, as described below.

The specific dimensions and materials recited above are given by way of example only and may be varied in practice according to conditions of use and the requirements thereof.

Figure 3:
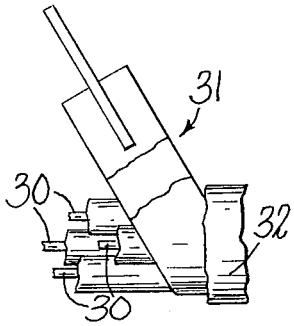
FIG. 3 represents a detail elevation of a piece of cable showing the relation of the conductor tape to the other elements of the cable.
Figure 4:
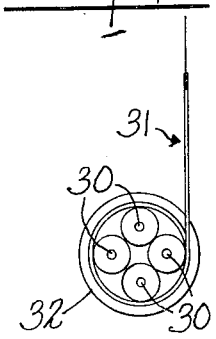
FIG. 4 represents a cross-sectional view of a cable.

Tapes of the types just described are made up in extended lengths such that they can be wound spirally, with a suitable overlap, on an electric cable, such a cable being represented, somewhat diagrammatically, in FIGS. 3 and 4 by the four conductors 30, the tape wrapping being indicated at 31 and a suitable jacket 32 being applied over the spiral wrapping. It will be understood that the special tape 31 may be applied to a cable of any size wherein there may be any number of conductors 30 carrying electric current for any purpose. The insulating films 15 and 25 are selected from materials which will melt or soften in a desired temperature range (e.g., 200°F. to 500°F.) and at temperatures which cannot adversely affect the foil strips or the kraft or Mylar backing strips. When any portion of one of the tapes is exposed to heat above the melting or softening point of the insulating film, the latter melts or softens, flows and permits the adjacent foil strips to come closely enough into contact with each other to close an alarm circuit and give warning of the over-heating condition. In the tape shown in FIG. 2, closing of the circuit is aided by the provision of the copper ribbon 27 which is thicker than the film and, as assembled, presses against the adjacent film 25 and thus tends to displace the film immediately upon any softening or melting thereof whereby to establish contact with the foil 22.

One or more of the conductors may be in, or associated with, a circuit containing conventional fire detection devices at strategic locations and the high temperature detecting tape circuit then serves to supplement and back up the fire detection circuit. Examples of such combinations are shown in FIGS. 5, 6 and 7.

Figure 5:
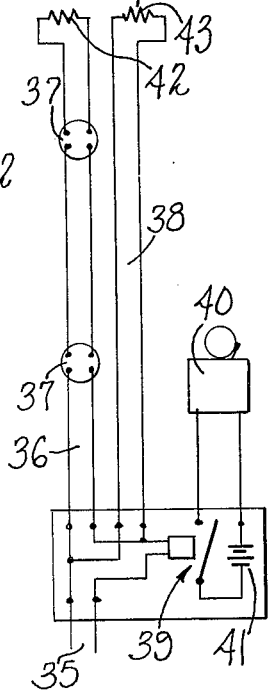
FIG. 5 is a circuit diagram showing one possible application of the invention.

In the circuit of FIG. 5 a low voltage (e.g., 15v.) is supplied at 35 to the fire detection circuit 36 having conventional detection devices 37 therein, the current being supplied also to the high temperature detecting tape circuit 38, connected in parallel with the circuit 36, while the relay 39 is in series with each detecting circuit. The detection circuit 38 may be disposed to cover the same area as the circuit 36 or it may cover a different area. The relay, when actuated, closes the circuit of the alarm device 40 which is supplied with any needed current from a source 41. Each of the circuits 36, 38 is preferably terminated by a line resistor 42, 43 (or relay) to permit current leakage for constant monitoring of the integrity of the circuits by a fault detector without actuation of the relay 39. The alarm device 40, shown as a bell, could be of any nature—audible and/or visual, or could include means for effecting a result such as closing a fire door or activating fire extinguishing devices; the power source 41 may have a capacity as great as needed to effect the desired result. If the alarm device requires only the same current as that supplied at 35, it might be practical to eliminate the relay. The fire detection circuit 36 may be in its own cable or may be in a cable with other conductors, the detecting tape 38 being wrapped around the cable, as described above, in either case.

Figure 6:
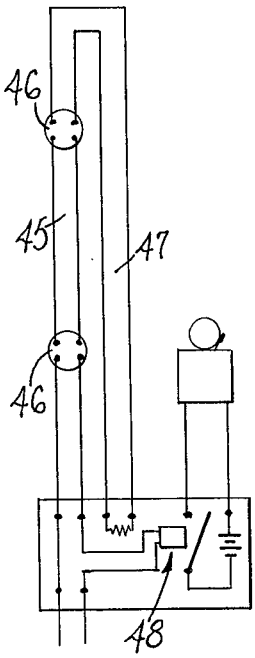
FIG. 6 is a circuit diagram showing a second possible application of the invention.

In the circuit of FIG. 6, the fire detection portion 45, having detection devices 46, is in series with the high temperature detecting tape portion 47, the relay 48 being in series with both portions, as shown. The current supply, relay and alarm circuit are the same as in FIG. 5. The circuit portion 45 is designed to be in a cable, alone or with other conductors, and the tape portion 47 is wound spirally around the cable, as previously described. When the combined circuit 45–47 is subjected to excess heat, as from a fire, it can be closed by the operation of one or more of the fire detection devices 46 or by the shorting of the conductors at one or more points in the tape portion 47, or both.

Figure 7:
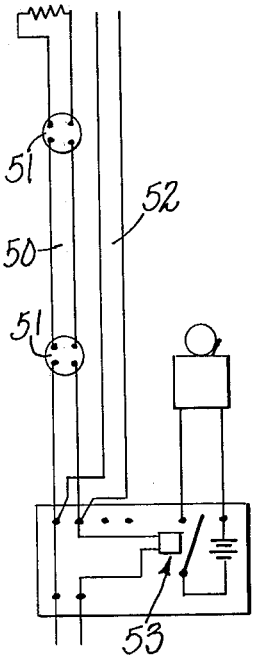
FIG. 7 is a circuit diagram showing a third possible application of the invention.

The system of FIG. 7 is similar to that of FIG. 5 in that the fire detection portion 50, having detection devices 51, is connected in parallel with the high temperature detecting tape portion 52, both being in series with the relay 53. In this system, however, the heat sensitive conductors in the portion 52 are not terminated by an end of line device, so that the system is not supervised against discontinuity.

Examples of insulating materials which would melt or soften to permit closing of the circuit between the foil strips include:

- Low molecular weight polyethylene film, perforated or not.
- Blends of low molecular weight polyethylene and carbon black.
- Blends of low melting wax and carbon black.
- Blends of silicone-pressure-sensitive adhesive, low molecular weight polyethylene and carbon black.
- Films of cellulose acetate, PVC, polyethylene or polyester.
- Filament reinforced tapes.

- Copper foil, polyethylene coated tapes.

The use of a slightly conductive film as the insulating material may be resorted to, as a practical matter, to insure a fail-safe contact between the conductors (e.g., in case a film of the material remains after the melting has taken place).

Any such material not having sufficient inherent adhesive characteristics may be supplemented by application of an adhesive, as shown in FIGS. 1 and 2.

In closed circuit systems heretofore known, where opening of the circuit triggers an alarm, any occurrence which interrupts the flow of current either in the detection system or at a point remote therefrom will set off the alarm. An advantage of the open circuit system described herein is that it responds only to the shorting of its conductors within the area to be observed; a failure of current supply outside the system may be detected by some separate means, if desired, but it will not trigger the alarm in the heat detection system nor otherwise affect its integrity.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

What is claimed is:

1. A heat detecting tape comprising first and second supporting strips of sheet material, first and second strips of conductive foil backing each of said supporting strips and facing each other, and a film of insulating material separating said foil strips and adhered directly to the facing surfaces thereof, said insulating material being selected to have a melting point in the range of approximately 200°F. to 500°F.

2. A heat detecting tape according to claim 1 wherein the insulating material is adhesive.

3. A heat detecting tape according to claim 1 which includes adhesive material between the insulating material and the foil.

4. A heat detecting tape according to claim 1 which includes a conductive wire extending lengthwise of the tape in contact with a surface of one of the foil strips.

5. A heat detecting tape according to claim 4 wherein the conductive wire has a thickness greater than the thickness of the insulating film.

6. A heat detecting circuit comprising a tape according to claim 1, a source of electric current connected to the strips of conductive foil and an electric current responsive device between said source and one of said strips.

7. A heat detecting circuit according to claim 6 wherein the source of electric current is connected to the strips of foil at one end of the tape.

8. A heat detecting circuit according to claim 7 which includes an end of line device connecting the strips of foil at the other end of the tape.

9. A heat detecting tape according to claim 1 wherein the insulating material has blended therein a conductive material.

* * * * *